US007837204B1

(12) United States Patent
Groenenboom

(10) Patent No.: US 7,837,204 B1
(45) Date of Patent: Nov. 23, 2010

(54) ADJUSTABLE KINGPIN BOARD APPARATUS AND METHOD

(76) Inventor: Mark Groenenboom, 3411 Grant St., Vancouver, WA (US) 98660

( * ) Notice: Subject to any disclaimer, the term of this patent is extended or adjusted under 35 U.S.C. 154(b) by 1007 days.

(21) Appl. No.: 11/206,965

(22) Filed: Aug. 17, 2005

(51) Int. Cl.
*A63C 17/02* (2006.01)

(52) U.S. Cl. ..... 280/11.27; 280/87.042

(58) Field of Classification Search ..... 280/87.042, 280/87.03, 87.05, 11.27, 11.28
See application file for complete search history.

(56) References Cited

U.S. PATENT DOCUMENTS

| | | | | |
|---|---|---|---|---|
| 3,442,523 | A | 5/1969 | Butler | |
| 4,029,330 | A * | 6/1977 | Runyan, Jr. | 280/87.042 |
| 4,060,253 | A | 11/1977 | Oldendorf | |
| 4,089,536 | A | 5/1978 | Larrucea | |
| D252,346 | S | 7/1979 | Solheim | |
| D252,347 | S | 7/1979 | Solheim | |
| 4,159,830 | A | 7/1979 | Solimine | |
| 4,181,316 | A * | 1/1980 | Brand et al. | 280/11.207 |
| 4,251,087 | A | 2/1981 | Hansen | |
| D302,993 | S | 8/1989 | Heilig | |
| 5,114,166 | A * | 5/1992 | McCosker | 280/87.042 |
| 5,615,901 | A * | 4/1997 | Piotrowski | 280/7.14 |
| 5,803,467 | A * | 9/1998 | Piotrowski | 280/7.14 |
| 5,992,861 | A * | 11/1999 | Piotrowski | 280/7.14 |
| 5,997,018 | A * | 12/1999 | Lee | 280/87.042 |
| 6,123,348 | A | 9/2000 | Miller | |
| 6,182,985 | B1 * | 2/2001 | Wang et al. | 280/87.041 |
| 6,227,555 | B1 * | 5/2001 | Wang et al. | 280/87.042 |
| 6,318,739 | B1 * | 11/2001 | Fehn, Jr. | 280/11.28 |
| 6,568,695 | B2 * | 5/2003 | Dornan | 280/87.042 |
| D478,643 | S | 8/2003 | Langford | |
| 6,896,274 | B2 * | 5/2005 | Leslie | 280/87.042 |
| 7,040,638 | B2 * | 5/2006 | Cole | 280/87.042 |
| 7,159,879 | B2 * | 1/2007 | Cole | 280/87.042 |
| 7,216,876 | B2 * | 5/2007 | Cole et al. | 280/43.23 |
| 7,243,925 | B2 * | 7/2007 | Lukoszek | 280/11.28 |
| 7,255,356 | B2 * | 8/2007 | Lin | 280/87.041 |
| 7,261,305 | B2 * | 8/2007 | Cole | 280/87.042 |
| 7,303,199 | B2 * | 12/2007 | Chen | 280/87.041 |
| 7,374,179 | B2 * | 5/2008 | Cole | 280/11.27 |
| 7,438,303 | B2 * | 10/2008 | Cole | 280/87.042 |
| 2005/0269794 | A1 * | 12/2005 | Lukes | 280/87.042 |
| 2007/0262546 | A1 * | 11/2007 | Bertiller | 280/87.042 |

OTHER PUBLICATIONS

Undated photograph of adjustable truck system from http://www.peterverdonedesigns.com/pvdtrucks.htm; one page.

* cited by examiner

*Primary Examiner*—Jeffrey J Restifo
(74) *Attorney, Agent, or Firm*—Rylander & Associates PC; Kurt M. Rylander; Mark E. Beatty

(57) ABSTRACT

An adjustable hanger pivot angle and kingpin board apparatus includes a truck having wheels, a hanger, and a kingpin, a truck base plate attached to said truck, and, a curving track adjustably connected to said base plate to adjust the kingpin in relation to the curving track. An adjustable hanger pivot angle and kingpin board apparatus, includes a truck having wheels, a hanger, and a kingpin, a truck base plate attached to said truck, a truck round attached fixedly to said truck, said truck round including a flat bottom and curved top, and, a curving track attached adjustably to said truck base plate through said truck round to adjust said hanger pivot angle and kingpin angle in relation to the curving track. A skateboard provided with one or more adjustable hanger pivot angle and kingpin board apparatus.

29 Claims, 5 Drawing Sheets

Fig. 1
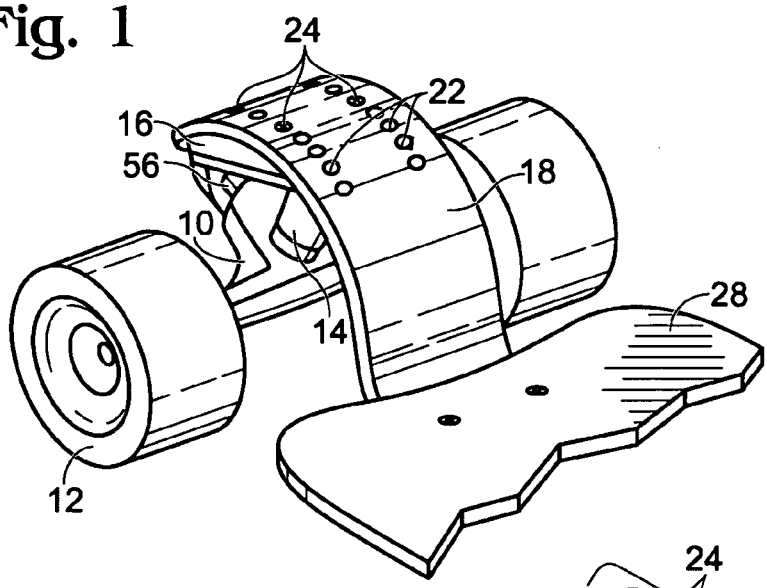
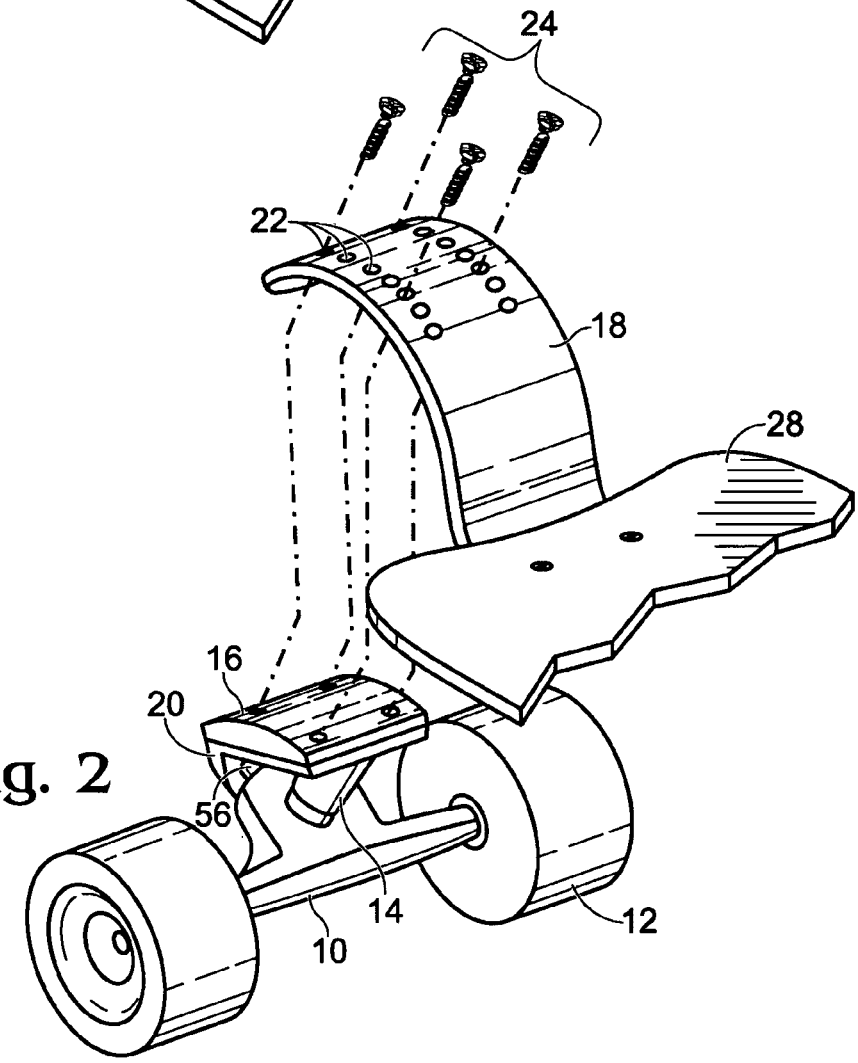
Fig. 2

Fig. 3
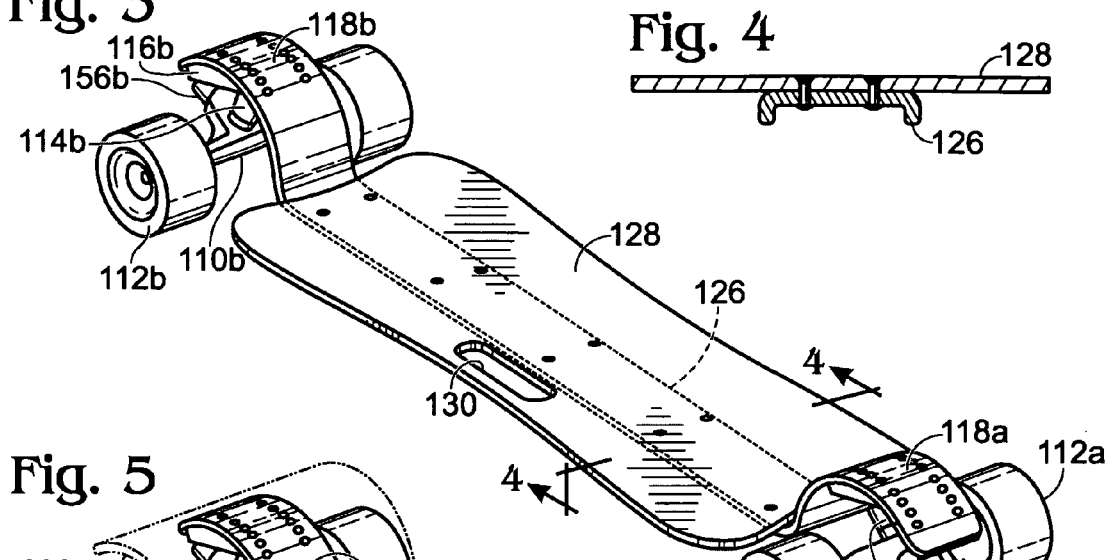
Fig. 4
Fig. 5
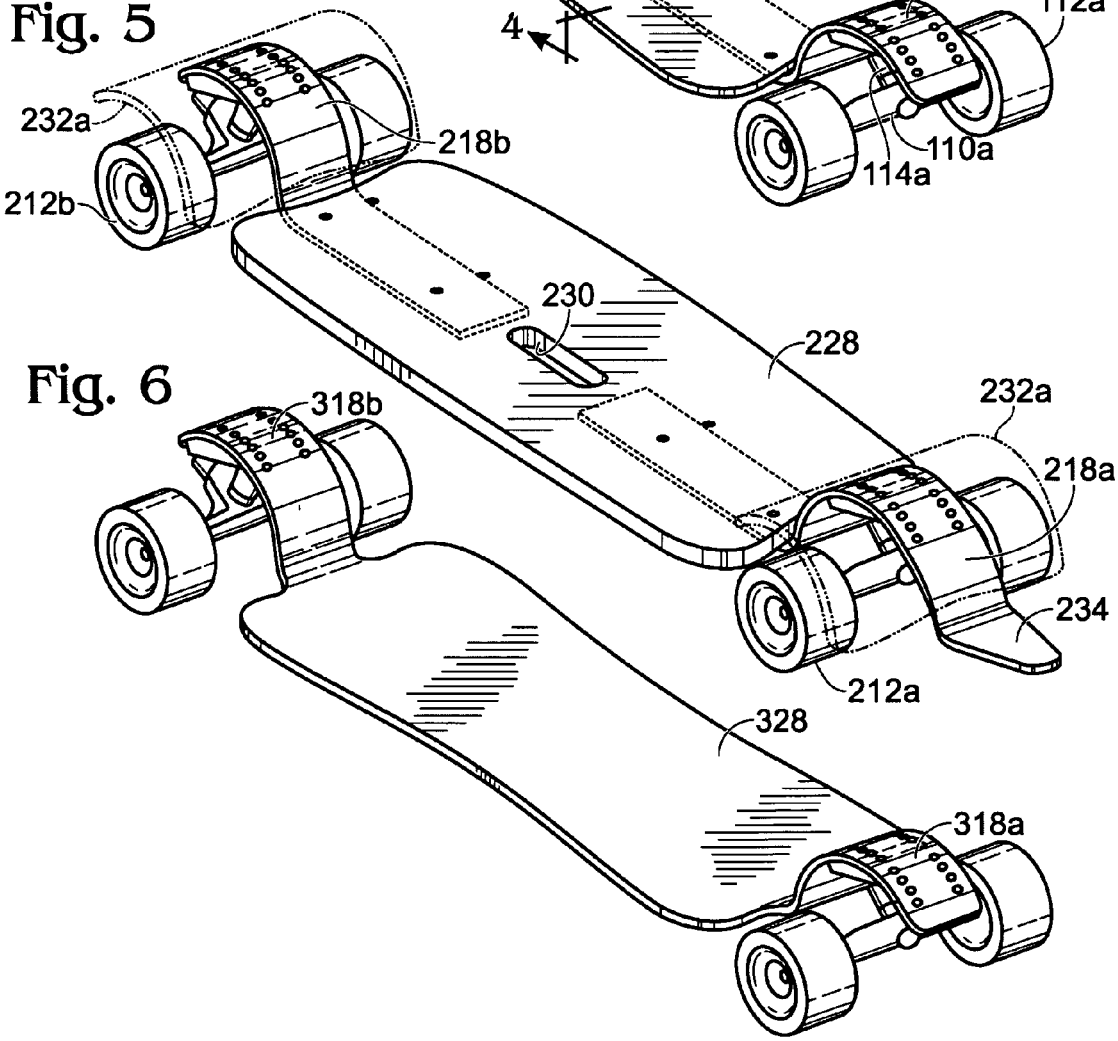
Fig. 6

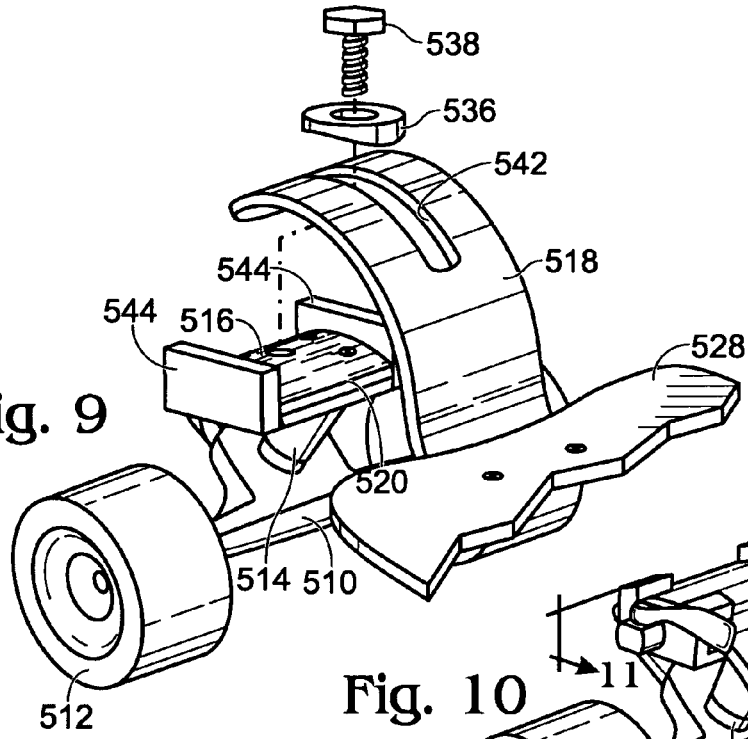
Fig. 9
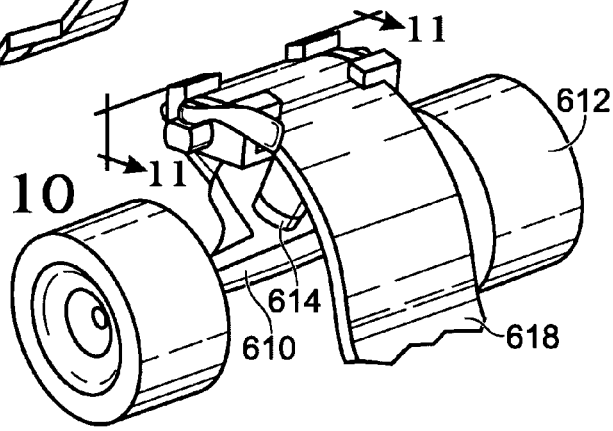
Fig. 10
Fig. 11
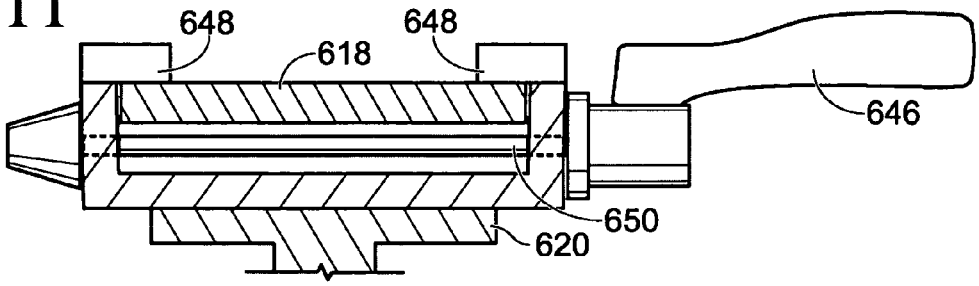
Fig. 12
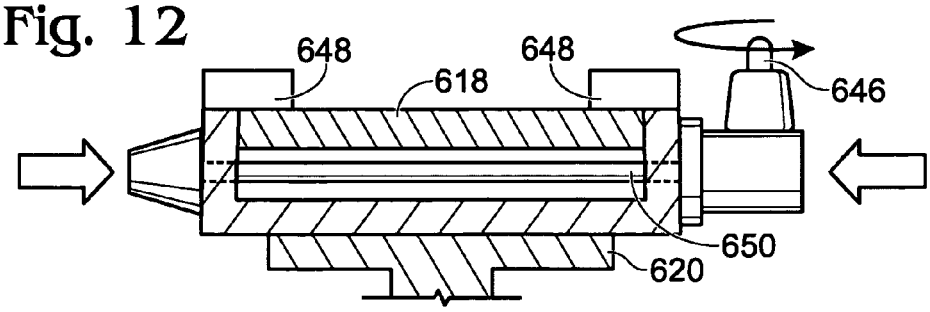

ADJUSTABLE KINGPIN BOARD APPARATUS AND METHOD

FIELD OF THE INVENTION

The present invention relates to skateboards and scooters. More particularly, the present invention relates to hanger and kingpin angle adjustment methods and devices.

BACKGROUND

Skateboards and scooters utilizing trucks with hangers, kingpins, and base plates are known in the art. Skateboards generally have a pair of trucks mounted in opposing orientation to the underside of a board, either attached directly to the board using truck base plates or attached to the board through truck blocks. Generally, a skateboard style truck includes a hanger, a hanger pivot, a kingpin, and a pair of wheels. The hanger includes a race for the wheel axle and bearings. The hanger pivot permits the hanger to rotate the wheels and axle in the plane of the wheels and axle. The kingpin intersects the hanger approximately perpendicular to both the pivot axis and the wheel axle. In basic operation, when a skateboard or scooter rider leans to one side or the other, causing the board to tilt, the hanger pivot and kingpin, acting together, cause the hangers, and therefore the wheel axles, to rotate in the plane of travel. This rotation of the axles, in opposite directions, causes the board to turn, with the radius of the turn determined by the amount of rotation of the axles in the plane of travel—the plane of travel being a plane containing the contact points of the wheels. In this manner, a certain angle of tilt left or right will result in a corresponding turning radius. Changing the vertical angle of the truck in relation to the board (i.e. within the plane normal to the board and bisecting the board lengthwise) changes the orientation of the hanger and kingpin in relation to the board, thereby changing the amount of rotation of the wheel axles in relation to a given angle of board tilt. The effect is that a skateboarder may vary the responsiveness of the skateboard by varying the vertical angle of one or both trucks in relation to the board.

Scooters often have either a pair of opposingly oriented trucks with kingpins, as with skateboards, or a combination of one truck, with a kingpin, and a steerable single-wheel or double-wheel truck controlled by an attached vertical handle. In operation, tilting a scooter to one side or the other causes the skateboard-style trucks to operate in the same manner as described for the skateboard, above.

Trucks where the hanger and kingpin are constructed as a single piece, using elastomeric materials, are also known. In operation when the board to which these single-piece trucks are attached tilts left or right, the truck deforms to rotate the wheel axles within the plain of travel in substantially the same manner as trucks with separate hanger, hanger pivot, and kingpin parts. These single-piece trucks are generally mounted in the same manner as conventional trucks.

Devices providing the ability to vary the angle of the hanger and kingpin are therefore known, but are inconvenient to use and cause other undesired changes in performance. The following represents a list of known related art:

| Reference: | Issued to: | Date of Issue: |
|---|---|---|
| U.S. Pat. No. 6,896,274 | Leslie | May 24, 2005 |
| U.S. Pat. No. 4,251,087 | Hansen | Feb. 17, 1981 |
| U.S. Pat. No. 4,159,830 | Solimine | Jul. 3, 1979 |

-continued

| Reference: | Issued to: | Date of Issue: |
|---|---|---|
| U.S. Pat. No. 4,089,536 | Larrucea | May 16, 1978 |
| U.S. Pat. No. 4,060,253 | Olendorf | Nov. 29, 1977 |
| U.S. Pat. No. 3,442,523 | Butler | Feb. 1, 1967 |
| U.S. Design Pat. No. 478,643 | Langford | Aug. 19, 2003 |
| U.S. Design Pat. No. 302,993 | Heilig | Aug. 22, 1989 |
| U.S. Design Pat. No. 252,347 | Solheim | Jul. 10, 1979 |
| U.S. Design Pat. No. 252,346 | Solheim | Jul. 10, 1979 |

The teachings of each of the above-listed citations (which does not itself incorporate essential material by reference) are herein incorporated by reference. None of the above inventions and patents, taken either singularly or in combination, is seen to describe the instant invention as claimed.

U.S. Pat. No. 6,896,274 to Leslie teaches a skateboard with an arched board, bumpers extending forward and aft beyond the wheels, and foot straps. Leslie also teaches advantages of lowering the center of gravity of the board by lowering the center section of the board, in order to replicate the feel of a snowboard.

U.S. Pat. No. 4,251,087 to Hansen teaches using a trucks mounted to a base plates the bottom side of a skateboard allowing adjustment to pre-determined angles using co-axially installed angled wedges, or using a pivoting base plate with a hinge and cotter bolt. Changing the incidence angle of the hanger pivot angle and kingpin requires either replacing the angled wedges (which requires disassembly of the truck) or removing and reinstalling the locking bolt of the hinged base plate mechanism. The methods taught in Hansen require access to the bottom of the skateboard and tools to accomplish adjustments. Use of the pivoting base plate of Hansen introduces mechanical play from the base plate hinge and cotter bolt mechanisms into to the steering and suspension system, with consequent increase in vibration or wobble at higher speeds, and less precise response in tight turns.

U.S. Pat. No. 4,060,253 to Oldendorf teaches use of angled wedges as truck to pads to mount between the trucks and the bottom of the board in order to change the turn radius of the board. Use of angled wedges, as taught in Hansen and Oldendorf, does not allow for user-determined minor adjustments and requires disassembly of the trucks and consequent realignment when replaced.

U.S. Pat. Nos. 4,159,830; 4,089,536; and 3,442,523 to Solinine, Larrucea, and Butler, respectively, teach methods for tuning the responsiveness of the trucks to turning forces. The listed design patents teach various shapes for skateboards, including boards with lowered center sections and with extensions forward and aft beyond the wheels.

All of the known methods for changing the hanger and kingpin angle share common disadvantages: (1) the adjustment mechanisms are necessarily located underneath the board, making them inconvenient to adjust; (2) adjustment means requiring disassembly of the truck assemblies; (3) altering the hanger and kingpin angle also changes the height of the board deck, thereby changing the vertical center of gravity and causing undesirable changes in stability characteristics; (4) the hanger and kingpin can only be adjusted to pre-determined angles; and, (5) the range of adjustment is limited by the clearance underneath the board.

Thus, while the foregoing body of art indicates it to be well known to have a means for adjusting the angle of the trucks, including hangers and kingpins, of a skateboard to vary the turn radius, the art described above does not teach or suggest a board which has the following combination of desirable features: (1) adjustment means accessible by the user from above the board; (2) the ability to adjust hanger and kingpin angle without significantly changing the vertical center of gravity; (3) the ability to adjust kingpin angle in fine gradations; (4) adjustment range not limited by clearance under the board; (5) adjustment requiring no tools or minimal tools to adjust; (6) an hanger and kingpin angle adjustment apparatus installed on a board with lowered center section; and (7) quick and easy changing of truck and wheel assemblies from one skateboard to another.

SUMMARY AND ADVANTAGES

The present invention relates to a hanger and kingpin angle adjustment apparatus for a skateboard or scooter. A hanger and kingpin angle adjustment apparatus includes a truck with a hanger, hanger pivot, and kingpin, a truck base plate attached to said truck, and a curving track adjustably connected to said truck base plate to adjust the vertical angle of the truck in relation to the curving track. A hanger and kingpin angle adjustment apparatus includes a truck with a hanger and kingpin, a truck base plate attached to said truck, a truck round attached fixedly to said truck, said truck round including a flat bottom and curved top, and curving track attached adjustably to said truck base plate through said truck round to adjust said hanger and kingpin angles in relation to the curving track. A skateboard or a scooter may be provided with one or more a hanger and kingpin angle adjustment apparatus.

The invention allows the hanger and kingpin angles relative to a board to be adjusted from above, in any increments, without significantly changing the vertical center of gravity of the skateboard, and without tools or using minimal tools such as a key wrench or small screwdriver. In operation, adjustment of the hanger and kingpin angles toward or away from each other (singly or together) will cause the turning radius for a given tilt angle to change. By adjusting the hanger and kingpin angles away from each other the turning radius for a given tilt angle will be greater, so the rate of turn will be lessened, which is useful for higher speeds. Conversely, adjusting the hanger pivot and kingpin angles closer together causes reduction in the turning radius for a given tilt angle, so the rate of turn will be increased. Adjustment of both the front and rear hanger pivot and kingpin angles either forward or backward will result in the center of the turn being moved forward or backward. With fine adjustments for the and kingpin angles a rider will be able to adjust the turn of the skateboard to their liking.

The adjustable hanger pivot angle and kingpin apparatus of the present invention thus presents numerous advantages, including: (1) quick and easy adjustment from above; (2) adjustment of hanger pivot angle and kingpin angle does not significantly change the vertical center of gravity; (3) fine tuned adjustment to any angle of incidence within the range of adjustment; (4) hanger pivot and kingpin angle adjustment not limited by clearance under the board; (5) adjustment of hanger pivot and kingpin angle requiring no or minimal tools; (6) compatibility with boards having lower center sections for lower center of gravity; and (7) quick and easy changing of truck and wheel assemblies from one skateboard to another.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

FIG. 1 shows a partial view of an embodiment of the present invention.

FIG. 2 shows an exploded partial view of the embodiment of FIG. 5.

FIG. 3 shows an embodiment of the present invention.

FIG. 4 shows a view of the embodiment of FIG. 1.

FIG. 5 shows another embodiment of the present invention.

FIG. 6 shows another embodiment of the present invention

FIG. 9 shows an exploded partial view of another embodiment of the present invention.

FIG. 10. shows a partial view of another embodiment of the present invention.

FIG. 11 shows another view of the embodiment of FIG. 10.

FIG. 12 shows another view of the embodiment of FIG. 10.

DETAILED DESCRIPTION

Figure 7:
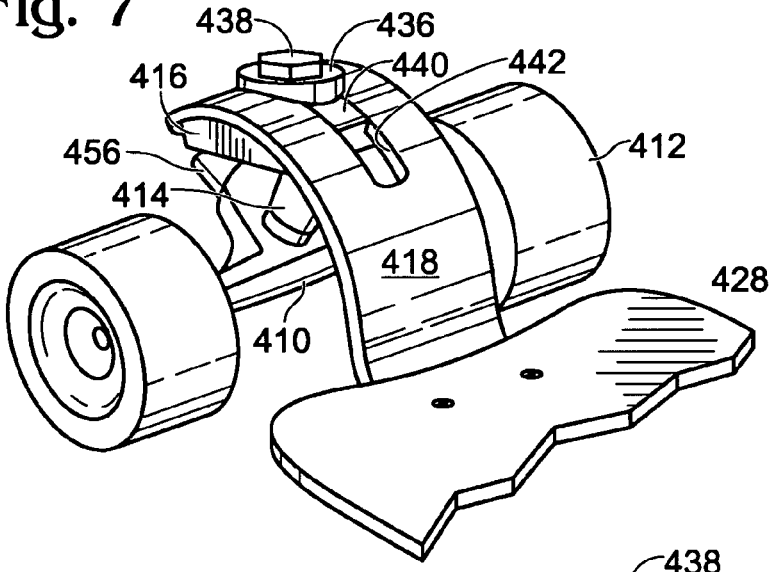
FIG. 7 shows a partial view of another embodiment of the present invention.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

A hanger and kingpin angle adjustment apparatus includes a truck having a hanger, a kingpin, a truck base plate attached to said truck, and a curving track adjustably connected to said base plate to adjust the hanger and kingpin angles in relation to the curving track. The truck base plate may be attached directly to the curving track, or may be connected through a truck round having a flat bottom surface to and a curved top surface matching the curvature of the curving track. The curving track may be attached to a board via a support frame, or directly to a board. Protective bumpers maybe attached to the curving track or the track may be made wide enough to serve as a bumper. Alternatively, the curving track, board, and bumpers may be formed as a single piece. A pair of adjustable hanger and kingpin is apparatus may be attached to a board in opposing directions, or a single adjustable hanger and kingpin may be mounted to a board in conjunction with another type of wheel mounting system, to provide ability to adjust turn radius. The present invention is applicable to skateboards, scooters, roller skates, or any other devices which utilize truck means which rotate the wheel axle in the plane of travel in the direction of the turn when tilted left or right. Throughout this specification, plane of travel indicates a plane including the points of contact of the wheels.

Referring to FIGS. 1 & 2 a first embodiment includes a truck with hanger 10, hanger pivot 56, and kingpin 14. Wheels 12, including axle and bearings, are attached to hanger 10. Truck round 16 is attached to truck base plate 20. Truck round 16 provides means to mount commercially available trucks using truck base plates with standard mounting bolt patterns. Truck round 16 has a flat bottom surface and curved top surface with radius of curvature approximately matching the radius of curvature of curving track 18. Curving track 18 is provided with adjustment holes 22, which allow rigid attachment of truck base plate 20 to curving track 18 using fasteners 24. Curving track 18 is rigidly attached to board 28 in this embodiment. Truck 10 and wheels 12 may be standard, commercially available parts known to those of skill in the art, or may be custom fabricated. Truck round 16, may be made of polyethylene, polyurethane, other plastics, metal, rubber or any material which generally retains integrity in compression. Curved tracks 18 may be constructed from any suitable metal, composite, or plastic material of sufficient strength. In this embodiment, aluminum is used for light weight and ease of machinability.

Referring to FIGS. 3 & 4, a second embodiment is shown which includes a skateboard with hangers 110*a-b*, hanger pivots 156*a-b* (156*a* not visible from this perspective), wheels 112*a-b*, and kingpins 114*a-b*. Curving tracks 118*a-b* are rigidly attached to support frame 126. Support frame 126 adds rigidity to the entire board apparatus and permits selection of different boards 128 based on functional or aesthetic concerns. In this first embodiment board 128 incorporates slotted handle 130. Slotted handle 130 may be positioned in the center, offset to one side or another convenient location, or excluded entirely. Curving tracks 118*a-b* may be widened to act as wheel guards or bumpers to protect wheels 112*a-b*.

Referring to FIG. 5, a third embodiment is shown, similar to the second embodiment, and which incorporates a tongue 234 extending forward past front wheels 212*a*, providing protection for the wheels. Curving tracks 218*a-b* attach directly to board 228, which incorporates slotted handle 230. Curving tracks 218*a-b* are provided with adjustment holes 222, which allow rigid attachment of the truck assemblies to curving tracks 218*a-b* using fasteners 224. Curving tracks 218*a-b* are rigidly attached to board 228. In this embodiment, board 228 incorporates slotted handle 230. Bumpers 232*a-b* may be attached to curving tracks 218*a-b* to protect wheels 212*a-b*. Alternatively, board 228 and bumpers 232*a-b* may be molded or fabricated from a single piece of material.

Referring to FIG. 6, a fourth embodiment is shown, similar to the first embodiments, in which curving tracks 318*a-b* and board 328 are molded, formed, or machined from a single piece of material.

Figure 8:
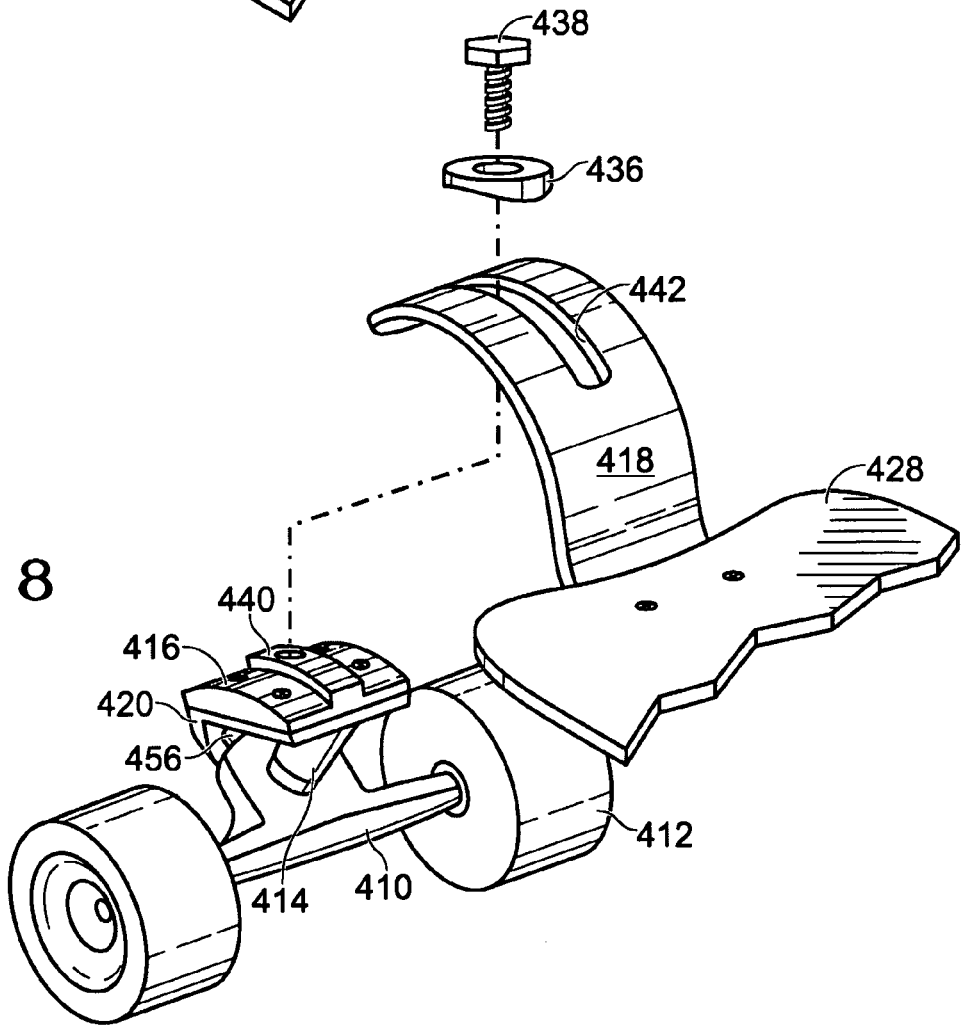
FIG. 8. shows an exploded partial view of the embodiment of FIG. 7.

Referring to FIGS. 7 & 8, a fifth embodiment is shown. Truck round 416 incorporates raised spine 440 fitting slidably within adjustment slot 442. Clamping bolt 438 with grommet 436 attaches truck base plate 420 to curving track 418. Loosening clamping bolt 438 permits adjusting the vertical angle of hanger 410 and kingpin 414 in relation to board 428. Raised spine 440 in conjunction with adjustment slot 442 prevents rotation of truck base plate 420. Curving track 418 attaches directly to board 428 in this embodiment.

Referring to FIG. 9, a sixth embodiment is shown similar to the fifth embodiment, above. Truck base plate 520 incorporates sidewalls 544, thereby preventing rotation of truck base plate 520.

Referring to FIGS. 10-13, a seventh embodiment is shown incorporating a quick release clamp for rapid adjustment. Quick release bracket clamp 648 is rigidly attached to truck base plate 620. Rotating quick release lever 646 parallel to quick release axle 650 loosens quick release bracket clamp 648, allowing adjustment of the vertical angle of hanger 610 and kingpin 614 in relation to curving track 618. Rotating quick release lever 646 perpendicular to quick release axle 650 tightens quick release bracket clamps 648, holding truck base plate 620 rigidly in place for use. Indicia 652 may be incorporated into curving tracks 618*a-b* to indicate the vertical angle of the hanger and kingpin apparatus. Other suitable quick release means are known in the art and may be used.

Figure 14:
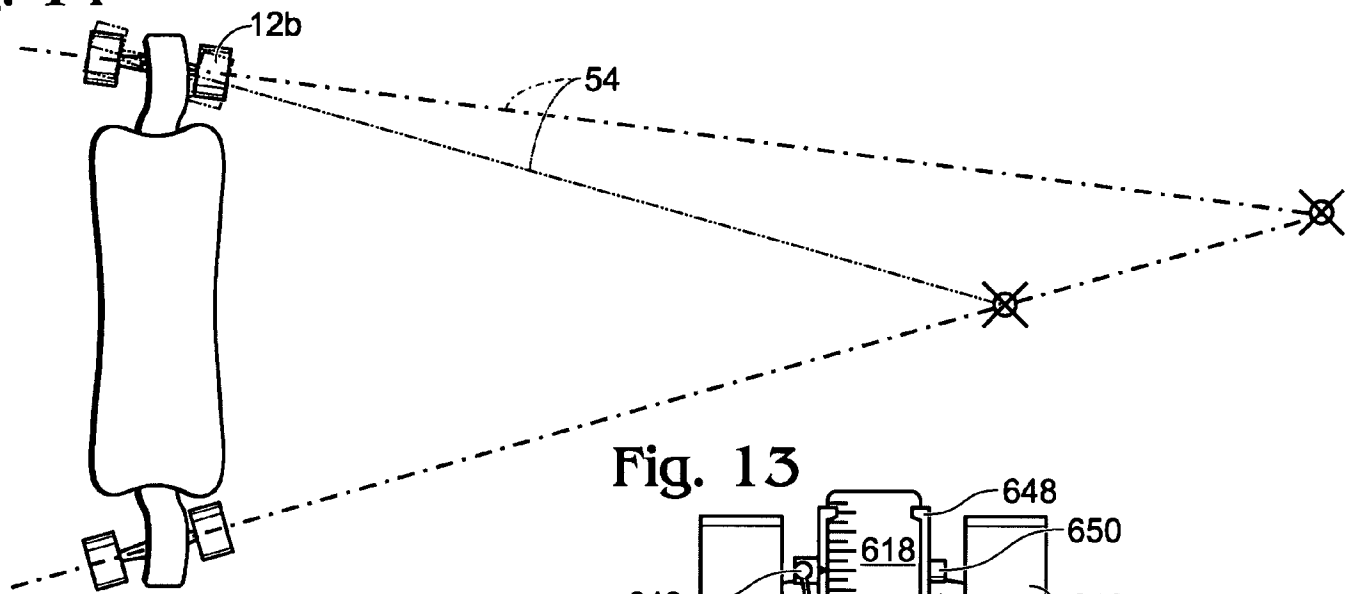
FIG. 14 shows a top down view of the present invention displaying the turning qualities.
Figure 13:
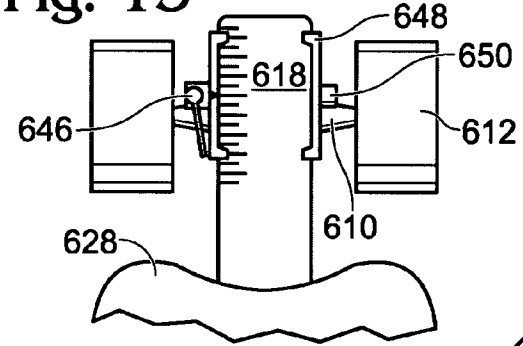
FIG. 13 shows a partial view of an embodiment of the present invention.
Figure 15:
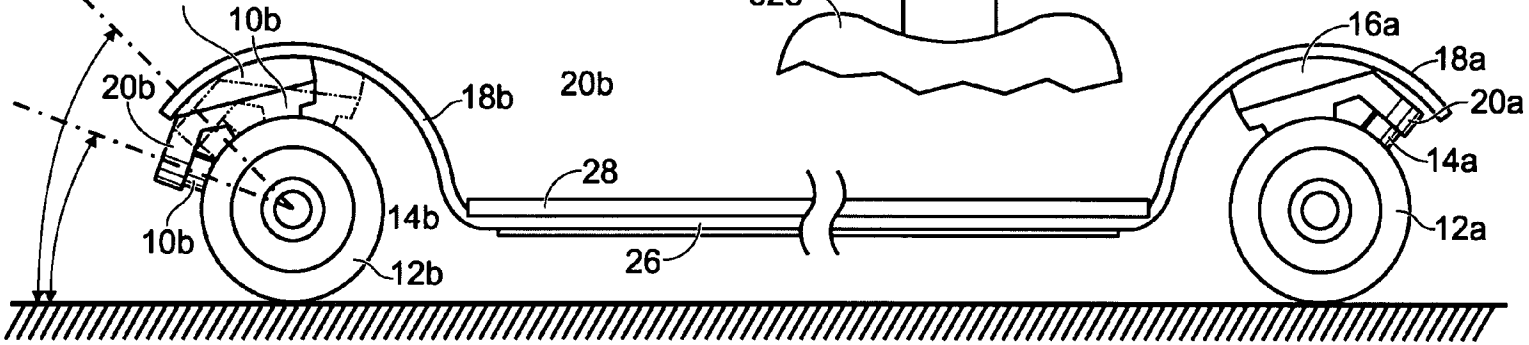
FIG. 15 shows a side view of the present invention displaying the adjustment qualities.

Referring to FIGS. 13-14 & 15, the basic operation of a skateboard utilizing the invention is shown. Adjusting the angle of hangers 10*a-b* and kingpins 14*a-b* toward the center of board 28, singly or together, causes turn radius 54 for a given amount of tilt to become smaller, so the skateboard can turn more tightly and is more responsive for tight maneuvering. Adjusting the angle of hangers 10*a-b* and kingpins 14*a-b* away from the center of board 28 lengthens the turn radius, reducing the responsiveness for higher speeds. Adjustment of both the angle of hangers 10*a-b* and kingpins 14*a-b* either forward or backward will result in the center of the turn being moved forward or backward of the center of the board, this provides a change in the turning responsiveness of the board that is appreciated by some riders.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A hanger and kingpin angle adjustment apparatus for mounting a truck assembly to a board, said truck assembly including a truck having a hanger, a hanger pivot, a kingpin, and a base plate, and said board including an end portion, said apparatus comprising:

a curving track including a flat portion attachable to said board end portion, and an arcuate portion extending from said flat portion, said arcuate portion including a concave bottom face, such that when said flat portion is attached to said board end portion said arcuate portion projects beyond said board end and the highest point of said concave bottom face is at equal or greater height than said board; and, a truck round including a flat bottom surface and a convex top surface having a radius of curvature approximately matching the curvature of said arcuate portion concave bottom face;

wherein, said truck base plate is removably connectable to said truck round bottom surface and said truck round convex top surface is removably connectable to said concave bottom face at a plurality of user selectable positions so as to adjust the angle of said hanger and kingpin in relation to said curving track.

2. The hanger and kingpin angle adjustment apparatus of claim 1, wherein said curving track arcuate portion further includes a slot extending lengthwise along at least a portion of said arcuate portion, and said truck round further includes a raised spine which fits slidingly into said slot on said curving track.

3. The hanger and kingpin angle adjustment apparatus of claim 1, wherein said truck round is made from material selected from the group consisting of aluminum, aluminum alloy, composite, polyethylene, high-molecular-weight polyethylene, polyurethane, and high-density polyurethane.

4. The hanger and kingpin angle adjustable apparatus of claim 1, further provided with a board connected to said curving track flat portion.

5. The hanger and kingpin angle adjustment apparatus of claim 4, wherein said board incorporates a handle slot.

6. The hanger and kingpin angle adjustment apparatus of claim 4, further comprising a support frame, said support frame extending substantially the entire forward-to-aft length of said board, wherein said curving track flat portion is directly attached to said support frame, and said support frame is directly attached to said board.

7. The hanger and kingpin angle adjustment apparatus of claim 4, wherein said curving track and said support frame are formed as a single piece.

8. The hanger and kingpin angle adjustment apparatus of claim 1, further comprising a bumper attached to said curving track arcuate portion, said bumper sized to substantially cover a pair of wheels attached to said truck.

9. The hanger and kingpin angle adjustment apparatus of claim 8, wherein said bumper is wider than said pair of wheels.

10. The hanger and kingpin angle adjustment apparatus of claim 1, wherein said curving track arcuate portion is at least as wide as said wheels and substantially covers said wheels.

11. The hanger and kingpin angle adjustment apparatus of claim 1, wherein said curving track includes a tongue extending lengthwise from said arcuate portion opposing said flat portion and beyond a pair of wheels attached to said truck.

12. The hanger and kingpin angle adjustment apparatus of claim 1, wherein said curving track arcuate portion is provided with indicia indicating the angular position of said hanger and kingpin angle adjustment apparatus.

13. The hanger and kingpin angle adjustment apparatus of claim 1, wherein said curving track arcuate portion is adjustably connected to said truck base plate by a quick release.

14. The hanger and kingpin angle adjustment apparatus of claim 1, wherein said truck base plate includes vertical sidewalls extending above said truck base plate spaced to border either side of said curving track arcuate portion.

15. The hanger and kingpin angle adjustment apparatus of claim 1, wherein said hanger and said kingpin are constructed as a single piece of elastomeric material.

16. The hanger and kingpin angle adjustment apparatus of claim 1, wherein said curving track is made from material selected from the group consisting of stainless steel, titanium, titanium alloy, aluminum, aluminum alloy, composite, and fiberglass.

17. A skateboard, comprising, a board including a fore and an aft portion;

first and second curving tracks, each of said curving tracks including a flat portion removably attached to said board fore or aft portion, respectively, and an arcuate portion extending from said flat portion, said arcuate portion including a concave bottom face, such that when said flat portion is attached to a respective board fore or aft end portion said arcuate portion projects beyond said board end portion and the highest point of said concave bottom face is at equal or greater height than said board;

first and second truck assemblies, each of said truck assemblies including a truck having a hanger, a hanger pivot, a kingpin, and a truck base plate, and, first and second truck rounds, each of said first and second truck rounds including a flat bottom surface and a convex top surface having a radius of curvature approximately matching the curvature of said respective first or second curving track arcuate portion concave bottom face; and, wherein, each of said first and second truck assembly base plates is removably connected to said first or second truck round bottom surface, respectively, and each of said first and second truck round convex top surfaces is removably connectable to said first or second curving track concave bottom faces, respectively, at a plurality of user selectable positions so as to adjust the angle of said first and second hangers and kingpins in relation to said first and second curving tracks, respectively.

18. The skateboard of claim 17, wherein the board and the first and second curving tracks are formed as a single piece.

19. The skateboard of claim 17, further comprising a bumper attached to at least one of said first and second curving track arcuate portions and substantially covering a pair of wheels mounted to said corresponding trucks.

20. The skateboard of claim 19, wherein said board and said at least one bumper are formed as a single piece.

21. The skateboard of claim 17, wherein at least one of said curving tracks includes a tongue extending lengthwise from said arcuate portion opposing said flat portion and beyond a pair of wheels mounted to said corresponding trucks.

22. The skateboard of claim 17, wherein said curving tracks arcuate portions include indicia indicating the angular position of said trucks.

23. The skateboard of claim 17, wherein said first and second truck base plates are adjustably connected to said respective first and second curving track arcuate portions through said truck rounds using a quick release.

24. The skateboard of claim 17, wherein each of said curving track arcuate portions further include a slot extending lengthwise along at least a portion of said arcuate portion, and each of said truck base plates include a raised spine which fits slidingly into said slot on said respective curving track.

25. The skateboard of claim 17, wherein said board includes a handle slot.

26. A hanger and kingpin angle adjustment apparatus for mounting a truck assembly to a board, said truck assembly including a truck having a hanger, a hanger pivot, a kingpin, and a base plate, and said board including an end portion, said apparatus comprising:

a curving track including a flat portion attachable to said board end portion, and an arcuate portion extending from said flat potion, said arcuate portion including a concave bottom face, such that when said flat portion is attached to said board end portion said arcuate portion projects beyond said board end and the highest point of said concave bottom face is at equal or greater height than said board; and, a truck quick release connector removably adjustably connectable to said curving track.

27. A hanger and kingpin angle adjustment apparatus as in claim 26, wherein said truck quick release connector comprises a first portion removably adjustably connectable to said curving track and a second portion removably connectable to said truck base plate.

28. A hanger and kingpin angle adjustment apparatus as in claim 27, wherein said truck quick release connector first portion further comprises a compression clamp selectively engageable with said curving track arcuate portion.

29. A skateboard, comprising:

a board including a fore and an aft portion;

first and second curving tracks, each of said curving tracks including a flat portion removably attached to said board fore or aft portion, respectively, and an arcuate portion extending from said flat potion, said arcuate portion including a concave bottom face, such that when said flat portion is attached to a respective board fore or aft end portion said arcuate portion projects beyond said board end portion and the highest point of said concave bottom face is at equal or greater height than said board;

first and second truck assemblies, each of said truck assemblies including a truck having a hanger, a hanger pivot, a kingpin, and a truck base plate, and, first and second truck quick release connectors, each of said first and second truck quick release connectors including a first portion removably adjustably connected to said curving track and a second portion removably connected to a respective truck base plate.

* * * * *